US006578447B1

(12) United States Patent
Fraser

(10) Patent No.: US 6,578,447 B1
(45) Date of Patent: Jun. 17, 2003

(54) ROTARY INDEXING APPARATUS AND RELATED METHODS

(75) Inventor: Charles R. Fraser, Kent, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/095,285

(22) Filed: Mar. 11, 2002

(51) Int. Cl.[7] ..... G05G 5/06; H01H 19/20
(52) U.S. Cl. ..... 74/527; 200/565
(58) Field of Search ..... 74/527, 531, 567, 74/569, 578, 553, 543, 548, 813 R, 813 C, 816, 817; 200/565, 570, 571, 336

(56) References Cited

U.S. PATENT DOCUMENTS 3,359,383 A * 12/1967 Cryer ..... 200/565
5,680,927 A * 10/1997 Thornton ..... 200/565
6,374,696 B1 * 4/2002 Blake et al. ..... 74/527

* cited by examiner

*Primary Examiner*—David A. Bucci
*Assistant Examiner*—Bradley J. Van Pelt
(74) *Attorney, Agent, or Firm*—Harness Dickey & Pierce P.L.C.

(57) ABSTRACT

A rotary indexing apparatus for positioning an external component secured thereto at one of a plurality of incrementally arranged detent positions. The apparatus includes a race ring having a race surface facing inwardly toward a central axis of the ring. The surface has alternating hills and valleys, each valley corresponding to a detent position. A detent wheel on a selection shaft is rotatable within the ring via the shaft. Two spring loaded, opposed race wheels on axles movably mounted within the detent wheel roll along the race surface while the shaft is being rotated. The race wheels roll into valleys upon a halting of the rotation. The apparatus facilitates positive positioning of the selection shaft while reducing friction.

22 Claims, 3 Drawing Sheets

ROTARY INDEXING APPARATUS AND RELATED METHODS

FIELD OF THE INVENTION

The present invention relates generally to rotary selection devices and, more particularly, to a rotating indexing apparatus with positive positioning.

BACKGROUND OF THE INVENTION

Indexing detent assemblies are found in a plurality of applications and are commonly used in rotary electronic switches. In such switches, considerable force frequently is needed to rotate the assembly. Detents commonly are engaged through use of bearings spring-mounted in a race configuration. Friction of the bearing assembly against the race frequently allows a selection shaft to stick between detents, where it fails to make an electrical connection. It would be desirable to provide a rotary detent indexing assembly that cannot be inadvertently left between detent positions. It also would be desirable to provide an indexing assembly in which friction is minimized.

SUMMARY OF THE INVENTION

In one preferred form, the present invention provides a rotary indexing apparatus for precisely positioning an external component secured thereto. The apparatus includes a race ring having a circumferential race surface facing inwardly toward an axial center of the race ring. The race surface includes a plurality of alternating hills and valleys, each valley configured to correspond to a detent position selectable by a user. The indexing apparatus also includes a selection shaft aligned with the axial center of the race ring. A detent wheel positioned on the selection shaft is rotatable within the ring by the user via the selection shaft. The detent wheel includes two spring loaded race wheels mounted in two substantially opposed recesses of the detent wheel, and two axles movably mounted within the recesses and upon which the race wheels are mounted. The race wheels are configured to roll along the race surface while the shaft is being rotated and to roll into valleys upon a halting of the rotation.

The above-described apparatus facilitates positive positioning of the selection shaft, and friction is reduced between the wheels and the race surface. The apparatus tends toward positive engagement in a detent, yet can be moved easily from one detent position to another. Implementing the above rotary indexing apparatus allows assembly time to be reduced and also eliminates or reduces need for replacement due to component failure. Utilizing the apparatus can make operation of operator-controlled devices more reliable and can lower maintenance costs.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
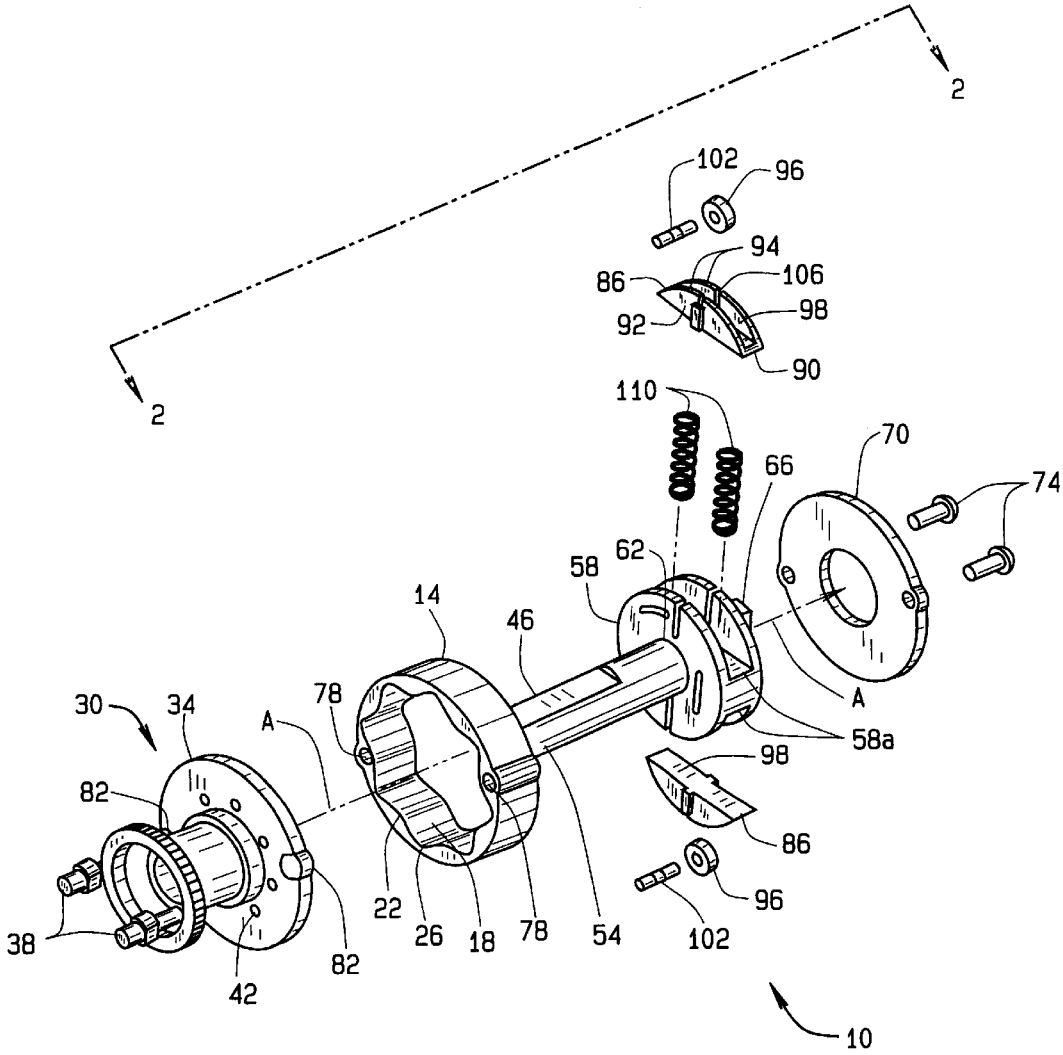
FIG. 1 is an exploded perspective view of a detent apparatus according to one embodiment of the present invention.

A rotary indexing apparatus according to one embodiment of the present invention is indicated generally in FIG. 1 by reference number 10. The apparatus 10 is configured to precisely position an external component secured thereto. As shown in FIG. 1, the apparatus 10 is configured for use in a magnetic switching module that utilizes Hall effect sensing. Thus the apparatus 10 is configured to precisely position a magnet secured thereto, as shall be further described below. The invention is not so limited, however, and embodiments are contemplated for use with other switching applications.

The apparatus 10 includes a race ring 14 having a circumferential race surface 18 that faces inwardly toward an axial center A of the ring 14. The surface 18 is undulating and includes a plurality of alternating hills 22 and valleys 26. As further-described below, each of the valleys 26 corresponds to a detent position selectable by a user. A mount bushing 30 is configured for mounting onto a printed circuit board (not shown) and includes a stop pin retainer 34. Two detent indexing pins 38 are configured for insertion through the circuit board to provide a fixed rotational positional reference relative to the circuit board. Each of a plurality of rotational stops 42 defines a selectable detent position and is configured to align with a corresponding race ring valley 26. A selection shaft 46 is aligned with the axial center A of the race ring 14. An end 54 of the shaft 46 extends through a hole in the circuit board and the mount bushing 30 and is rotatable by a user to select a detent position.

A detent wheel 58 having a pair of substantially opposed recesses 58*a* is affixed to another end 62 of the shaft 46. The detent wheel 58 is rotatable within the ring 14 via the selection shaft 46 as further described below. The shaft end 62 is configured for connection with a magnet control assembly 66 connected through a rear cover 70 with a magnet carrier (not shown). The apparatus 10 is held together by two cover retaining screws 74 extending through the rear cover 70 into opposed channels 78 in the race ring 14, and two adjustable stop pins (not shown) extending through opposed openings 82 in the stop pin retainer 34 into the channels 78.

Two sabots 86 fit inside the detent wheel 58 in the opposed recesses 58*a*. The sabots 86 are movable within the detent wheel 58 as further described below. Each sabot 86 includes a flat inner surface 90 and two parallel sides 92 terminating in outer edges 94. A race wheel 96 is movably mounted in each sabot 86, in a recess 98 defined by the flat inner surface 90 and sides 92. More specifically, each race wheel 96 is rotationally mounted on an axle 102 aligned with, and configured to move within, two parallel grooves 106 in the sides 92. The grooves 106 are oriented radially relative to the shaft 46. As shall be further described below, two opposed and substantially parallel springs 110 are compressed between the sabots 86 and tend to bias the sabots 86, and the race wheels 96, toward the race ring 14. Components of the apparatus 10 such as the race ring 14 are fabricated of, for example, stainless steel. The race wheels 96 also can be fabricated of bearing bronze.

Figure 2:
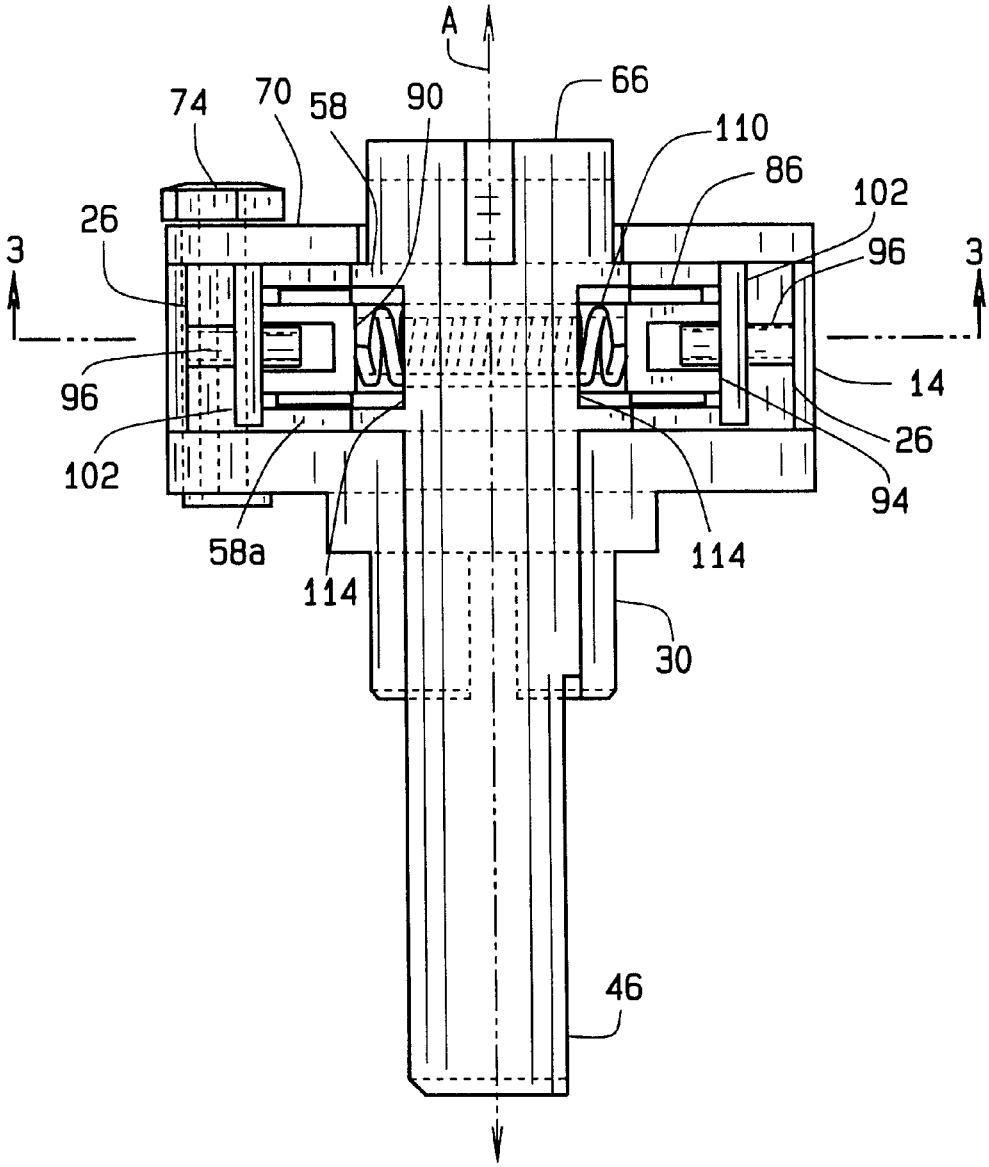
FIG. 2 is a sectional view of a portion of the detent apparatus indicated by line 2—2 of FIG. 1, the view taken along a plane that includes an axial center of the apparatus.

FIG. 2 is a sectional view of a portion of the apparatus 10 indicated by line 2—2 of FIG. 1. The view shown in FIG. 2 is taken along a plane that includes the axial center A. When, for example, a user has selected a detent stop 42 (shown in FIG. 1) by rotating the selection shaft 46, components of the apparatus 10 can be positioned as shown in FIG. 2. The edges 94 of the sabots 86 press against the axles 102. The spring-loaded race wheels 96 thus are pressed radially away from the shaft 46 into opposing valleys 26 of the race ring 14. Also shown in FIG. 2 are a pair of opposed flat tangential surfaces 114 of the detent wheel 58. The surfaces 114 are configured to abut against the flat surfaces 90 of the sabots 86 when the springs 110 are further compressed by movement of the sabots 86 as described below.

Figure 3:
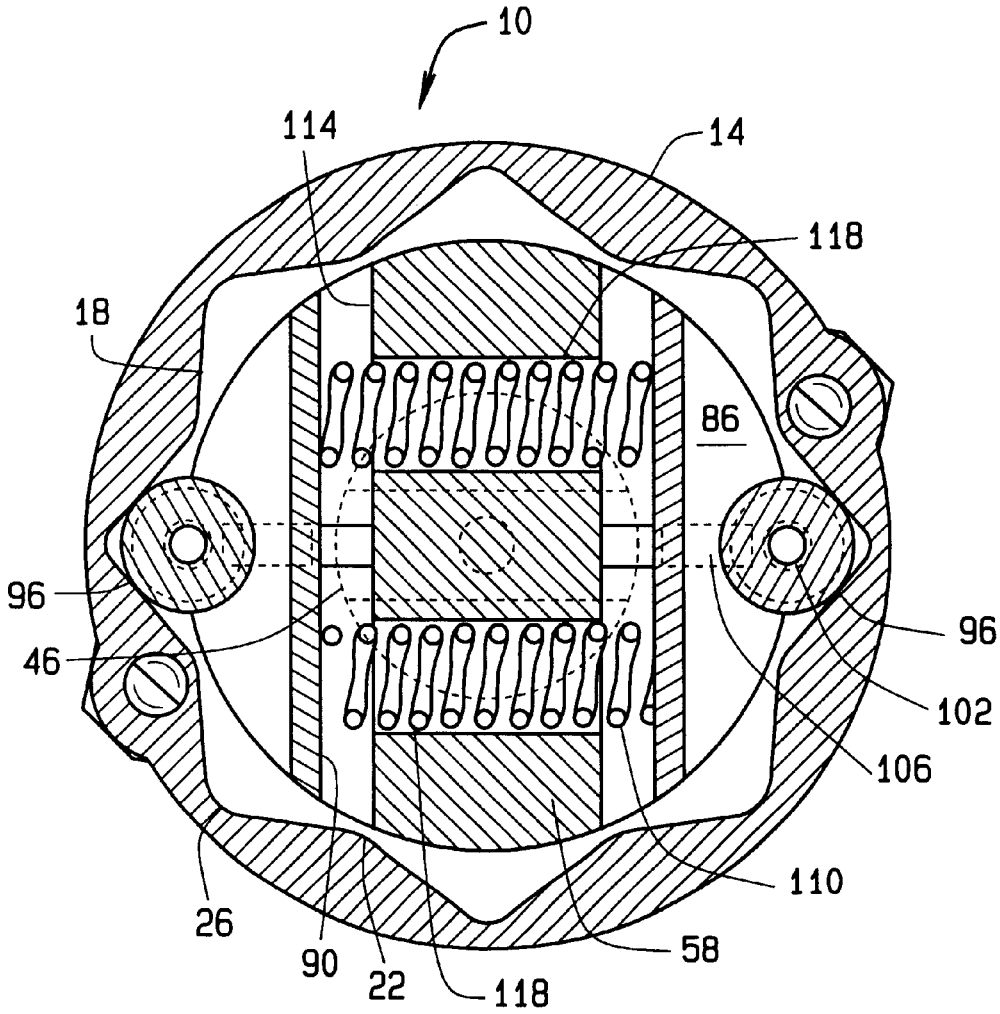
FIG. 3 is a cross-sectional view of the detent apparatus, taken along the plane of line 3—3 of FIG. 2.

FIG. 3 is a cross-sectional view of the detent apparatus 10, taken along the plane of line 3—3 of FIG. 2. The springs 110 extend between the sabot surfaces 90 through a pair of parallel opposed bores 118 through the detent wheel 58. The bores 118 are substantially perpendicular to the tangential surfaces 114 and the sabot surfaces 90.

In operation, a user selects a detent position by causing the shaft 46 to rotate toward a selected stop 42 (shown in FIG. 1). The race wheels 96 roll along the race surface 18 while the shaft 46 is being rotated. As the race wheels 96 move over hills 26, the wheels 96 and axles 102 are pressed radially inward toward the shaft 46. The axles 102 are pushed into the sabots 86 via grooves 106. The axles 102 move in the grooves 106 toward the shaft 46. When the axles 102 have moved as far toward the shaft 46 as permitted by the grooves 106, the sabots 86 are pushed toward and against the flat surfaces 90 of the detent wheel surfaces 114. Thus radial movement of the axles 102 relative to the shaft 46 is facilitated while tangential movement of the axles 102 relative to the shaft 46 is restricted.

Compression of the springs 110 varies with the movement of the race wheels 96 along the hills 22 and valleys 26 of the race ring 14. Upon a halting of the shaft 46 rotation at or next to the selected detent position, the opposed race wheels 96 tend to roll respectively into the valley 26 corresponding to the selected stop 42 and into an opposed valley 26. The wheels 96 are positively engaged in the valleys 26 by the pressure of the springs 110. The race wheels 96 also engage within the valleys 26 in the event that the selection shaft 46 is not perfectly positioned relative to any of the valleys 26. For example, if the user rotates the shaft 46 to a position between two detent stops 42, the race wheels 96 tend to roll from the corresponding hills 22 into valleys 26 adjacent the hill 22.

The above-described apparatus 10 facilitates positive positioning of the selection shaft with very little friction to overcome, since the race wheels 96 tend to roll rather than slide. Because friction is reduced between the wheels 96 and the hills 22 and valleys 26, the apparatus 10 tends toward positive engagement in a detent, even when the selection shaft 46 is placed between two detent positions. The apparatus can make the operation of operator-controlled devices more reliable, since it is difficult if not impossible to leave the apparatus 10 in a position in which no detent position is selected. The selection shaft 46 nevertheless can be easily moved from one position to another. Implementing embodiments of the rotary indexing apparatus 10 allows assembly time to be reduced. It also is estimated that the indexing apparatus 10 can be used up to about one million times without component degradation. Thus, a need for replacement due to component failure is eliminated or significantly reduced.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A rotary indexing apparatus for precisely positioning an external component secured thereto, the apparatus comprising:

a race ring comprising a circumferential race surface facing inwardly toward an axial center of the race ring, the race surface comprising a plurality of alternating hills and valleys, each valley configured to correspond to a detent position selectable by a user;

a selection shaft aligned with the axial center of the race ring; and a detent wheel positioned on the selection shaft and rotatable within the ring by the user via the selection shaft, the detent wheel comprising:

two spring loaded race wheels mounted in two substantially opposed recesses of the detent wheel, and two axles movably mounted within the recesses and upon which the race wheels are mounted, the race wheels configured to roll along the race surface while the shaft is being rotated and to roll into valleys upon a halting of the rotation.

2. The indexing apparatus of claim 1 wherein the axles are movably mounted so as to facilitate radial movement of the axles relative to the shaft while restricting tangential movement of the axles relative to the shaft.

3. The indexing apparatus of claim 1 wherein the detent wheel further comprises two opposed tangential flat surfaces and two sabots inside the detent wheel recesses within which are mounted the axles, each of the sabots comprising an inner flat surface configured to be pressed against a corresponding one of the tangential flat surfaces as a race wheel rolls on a hill of the race ring.

4. The indexing apparatus of claim 3 wherein the race wheels are spring loaded so as to be pushed against the race ring by two springs mounted between and pushing against the two sabots.

5. The indexing apparatus of claim 3 wherein each of the sabots further comprises two sides terminating in outer edges of the sabot through which a corresponding one of the race wheels is configured to contact the race ring, the two sides comprising two grooves extending radially from the shaft and in which a corresponding axle is configured to move.

6. The indexing apparatus of claim 5 further comprising two springs compressed between the inner flat surfaces of the sabots.

7. The indexing apparatus of claim 1 wherein the race ring comprises stainless steel.

8. The indexing apparatus of claim 7 wherein the race wheels comprise bearing bronze.

9. A rotary indexing apparatus comprising:

a selection shaft rotatable for selecting a detent position;

a detent wheel positioned on an end of the shaft and comprising two opposed tangential flat surfaces and two sabots substantially opposedly positioned inside the detent wheel over the tangential flat surfaces, the sabots comprising:

two pairs of parallel grooves oriented radially relative to the shaft; and a pair of race wheels and a pair of axles upon which the race wheels are each rotationally mounted, the axles aligned with the parallel grooves; and a race ring comprising an inner race surface surrounding the detent wheel and in contact with the race wheels, the inner race surface comprising a plurality of alternating hills and valleys, each valley corresponding to a detent position, the race wheels being adapted to engage within the valleys in the event the selection shaft is not perfectly positioned relative to any of the valleys.

10. The apparatus of claim 9 wherein the race wheels are configured to roll on the inner race surface while the shaft is being rotated and to roll into valleys upon a halting of the rotation.

11. The apparatus of claim 9 wherein the detent wheel comprises two opposed springs mounted between the sabots for biasing the sabots toward the race ring.

12. The apparatus of claim 11 wherein each of the sabots comprises a flat inner surface, the springs mounted between the sabot inner surfaces, the opposed tangential flat surfaces configured to abut against the sabot inner surfaces when the springs are compressed.

13. The apparatus of claim 9 wherein the race ring comprises a stainless steel material.

14. The apparatus of claim 9 wherein the race wheels comprise a bearing bronze material.

15. The apparatus of claim 9 wherein the detent positions correspond to switching positions for a magnetic switching module.

16. A method for providing rotary selection of detent positions in a rotary indexing apparatus having a detent wheel rotatable by a selection shaft within a race ring having a plurality of hills and valleys, each valley corresponding to a detent position, the detent wheel configured to be rotated by the shaft within the race ring to a selected detent position, the method comprising the steps of:

spring loading at least one race wheel mounted on an axle in the detent wheel such that the race wheel is pressed toward and rolls over the hills and valleys when the detent wheel is rotated; and facilitating radial movement of the axle relative to the shaft while restricting tangential movement of the axle relative to the shaft.

17. The method of claim 16 wherein the step of spring loading the race wheel is performed using a sabot and a spring opposed within the detent wheel.

18. The method of claim 16 wherein the step of facilitating radial movement of the axle comprises the step of providing for movement of the axle in two grooves oriented radially relative to the shaft.

19. A rotary indexing apparatus for precisely positioning an external component secured to the apparatus, the apparatus comprising:

a race ring comprising a circumferential race surface facing inwardly toward an axial center thereof, the race surface including a plurality of hills and valleys forming an undulating surface;

a selection shaft rotatable for selecting a detent position, the selection shaft being operably coupled to the external component;

a detent wheel positioned on the selection shaft so as to be disposed within the race ring, and rotatable by the selection shaft; and the detent wheel including at least one race engaging member disposed so as to engage within one of the valleys, and to maintain the detent wheel stationary, when rotational movement of the selection shaft is stopped.

20. The apparatus of claim 19 wherein the race engaging member comprises:

a race engaging wheel; and wherein the detent wheel comprises a biasing member operably associated with the detent wheel and the race engaging wheel for providing a biasing force to maintain the race engaging wheel in contact with the circumferential race surface.

21. The apparatus of claim 19 wherein the detent wheel comprises a pair of race engaging members disposed in opposing fashion on the detent wheel.

22. The apparatus of claim 19 wherein each of the race engaging members comprises a race engaging wheel disposed on the detent wheel for rotational movement.

* * * * *